US005863600A

United States Patent [19]

Walser

[11] Patent Number: 5,863,600

[45] Date of Patent: Jan. 26, 1999

[54] METHOD AND APPARATUS FOR UNIFORMLY APPLYING A COATING TO A CAN BODY

[75] Inventor: Felix Walser, Hinwil, Switzerland

[73] Assignee: Elpatronic AG, Bergdietikon, Switzerland

[21] Appl. No.: 788,687

[22] Filed: Jan. 24, 1997

[30] Foreign Application Priority Data

Feb. 21, 1996 [CH] Switzerland ..... 00447/96

[51] Int. Cl.[6] ..... B05D 7/22; B05D 1/12; B05C 5/00

[52] U.S. Cl. ..... 427/181; 427/475; 427/476; 427/477; 427/294; 427/295; 427/421; 118/621; 118/622; 118/308; 118/317

[58] Field of Search ..... 427/294, 295, 427/421, 458, 475, 477, 181, 476; 118/621, 308, 622, 317; 239/124

[56] References Cited

U.S. PATENT DOCUMENTS

| | | | |
|---|---|---|---|
| 3,901,184 | 8/1975 | Payne et al. . | |
| 4,114,810 | 9/1978 | Masuda | 239/15 |
| 4,259,923 | 4/1981 | Breen | 118/622 |
| 4,411,935 | 10/1983 | Anderson | 118/308 |
| 4,500,038 | 2/1985 | De Ferrari et al. . | |
| 4,886,013 | 12/1989 | Turner et al. . | |
| 5,612,096 | 3/1997 | Mulder et al. | 427/477 |

FOREIGN PATENT DOCUMENTS

| | | |
|---|---|---|
| A-0 093 083 | 11/1983 | European Pat. Off. . |
| A-0 120 810 | 10/1984 | European Pat. Off. . |
| A-0 192 969 | 9/1986 | European Pat. Off. . |
| A-0 732 151 | 9/1996 | European Pat. Off. . |
| A 22 52 736 | 5/1974 | Germany . |
| A 26 42 587 | 4/1977 | Germany . |
| WO-A 87 04643 | 8/1987 | WIPO . |

*Primary Examiner*—Katherine A. Bareford
*Attorney, Agent, or Firm*—McCormick, Paulding & Huber

[57] ABSTRACT

For the application of a coating material to an object, the coating material is conveyed along a conduit by means of an entraining gas. For good conveying conditions, the entraining gas is made to travel at high velocity. In order that the velocity of the coating material discharged at the coating zone is not excessive, a partial vacuum source extracts part of the entraining gas from a point upstream of the outlet, via a separate conduit. This results both in an improved rate of deposition of the coating material on the object to be coated and in a particularly uniform coating.

9 Claims, 2 Drawing Sheets

METHOD AND APPARATUS FOR UNIFORMLY APPLYING A COATING TO A CAN BODY

BACKGROUND OF THE INVENTION

The invention relates to a method for applying a coating to an object in which a particulate coating-material is conveyed along a transfer conduit by means of a fluid flow and is discharged from the line in a coating zone. The invention also relates to an apparatus for applying a coating to an object in which a particulate coating-material from a feed bin is conveyed along a transfer conduit by means of a fluid flow from a fluid source and, in a coating zone, is discharged from the line and impinges on the object to be coated.

Methods and apparatus of the said kind for the coating of objects are known. The coating particles are applied to the object to be coated, often under the influence of electrostatic charge, and yield a durable coating, eg. after heat treatment. In particular, such a process is known for the coating or spraying of the internal seams of can bodies, or of the entire internal wall of can bodies, with coating material. In the process, the coating material, usually a powder, has to be conveyed along an extended conduit, as the only way to gain access to the closed body of the can is through the welding machine. This long conduit requires the fluid, usually air, to be conveyed at high velocity in order to carry the powder in sufficient quantities along the extended conduit. However, a high air velocity or particle velocity at the discharge point is disadvantageous, since it may cause the powder particles to bounce off the surface to be coated, thus reducing the efficiency of the coating process. Furthermore there is a requirement that the coating material should be distributed as uniformly as possible at the point of discharge and upon impact on the object to be coated, in order that a coating of uniform thickness can be obtained; this is especially necessary when coating seams of can tubes or bodies.

It is therefore the object of the present invention to provide a method and an apparatus whereby high coating efficiency can be combined with good conveying conditions in the conduit, and whereby a highly uniform coating can be obtained.

SUMMARY OF THE INVENTION

This object is achieved in the method stated at the outset by bleeding part of the fluid flow from the conduit upstream of the outlet section.

In the apparatus stated at the outset, the object is realised by providing in the conduit, upstream of the discharge opening of the conduit, an opening which is coupled to a suction conduit by means of which a part of the fluid flow can be bled from the conduit.

Bleeding off part of the fluid causes a reduction in the velocity of the fluid in the downstream portion of the conduit, with the result that the coating particles are discharged at lower velocity and the deposition rate is thereby increased. Thus the invention brings about a separation from the fluid-powder mixture of fluid which is necessary for material handling purposes but whose presence is disruptive in the discharge zone and/or spraying zone. Furthermore the lower velocity and the associated rise in pressure induce turbulence in the oncoming particles, resulting in greater homogeneity of the flow of particles at the point of discharge.

Preferably, before part of the fluid flow is bled off, the flow is divided into a fluid flow which is lean in particles and a fluid flow which is rich in particles. Only the fluid flow which is lean, or essentially lacking, in particles is bled off. This leaves essentially the whole of the coating material conveyed along the conduit available for the coating or spraying, and only fluid which is required for conveying, but which would be disruptive in the coating zone, is bled off.

Separation into particle-lean and particle-rich fluid flows is preferably effected on the principle of the difference in mass between fluid and particles, in particular by a bend in the conduit.

Ways of carrying out the invention will now be described in more detail by way of example and with reference to the drawings, in which:

DESCRIPTION OF THE PREFERRED EMBODIMENTS

Figure 1:
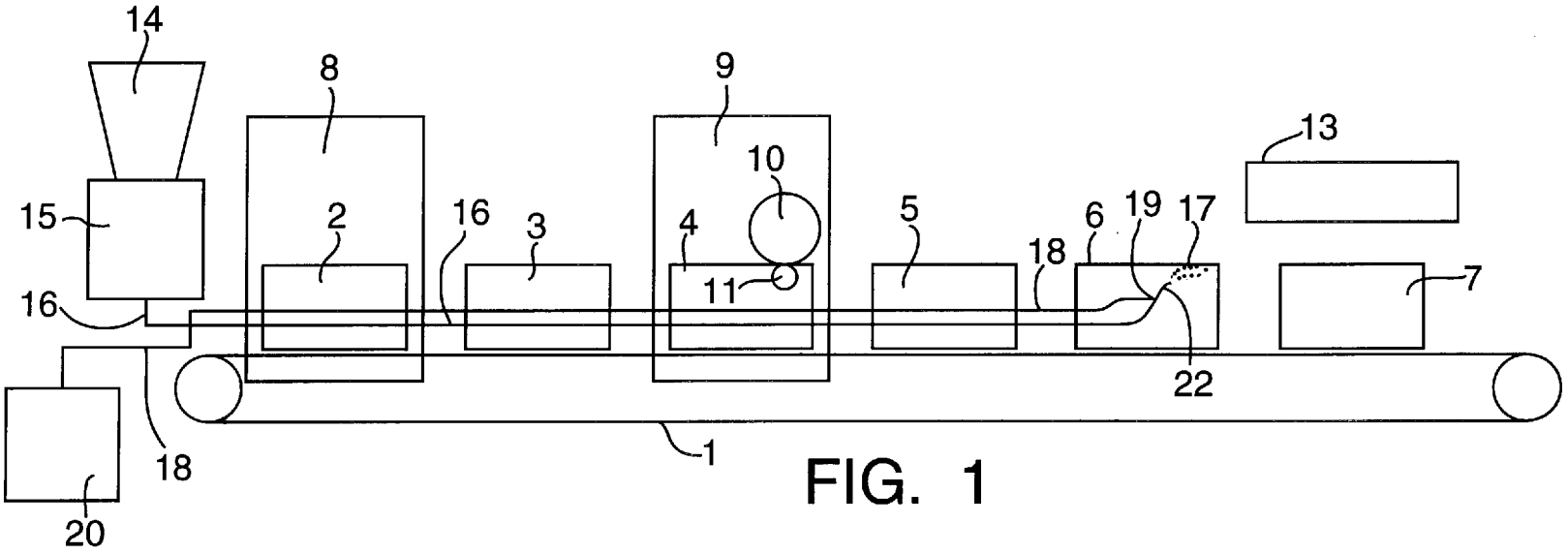
FIG. 1 shows schematically an installation for conveying coating powder for coating can bodies.

FIG. 1 is a schematic illustration of the construction of an installation for the manufacture and coating of can bodies. In the description which now follows, the invention will be explained by reference to this example, which is only a preferred embodiment. The invention can also be used in the coating of other objects.

FIG. 1 shows a conveyor device 1, schematically illustrated as a continuous belt-conveyor. In an actual installation of this type, a series of conveyors with corresponding transfer elements may be provided. The can bodies 2–7 conveyed on the conveyor device 1 are fabricated in a known manner, in a rounding station 8 a flat metal blank being formed into a can body with an as yet unclosed longitudinal seam. The longitudinal seam, which may be closed as the body passes along the conveyor line, is in any case made to overlap in the roller seam welding machine 9 so that the seam of the body can be welded by means of the welding rollers 10 and 11, usually with a wire electrode. The welded can bodies leave the welding machine and pass on to a coating station.

In the coating station, either the welded seam only or the entire internal wall of the body is coated with a coating material. In a known manner, this material may be a coating powder, which is applied in the interior of the can. The powder may be given an electrostatic charge to obtain good adhesion of the powder to the internal wall of the can. In a following station 13 the can body is then subjected to a heat treatment which fuses the powder. The coating then cools and hardens to its final condition. Application of the powder to the internal wall of the can body is performed by mixing the powder from a feed bin 14 with a gas flow in a mixer and conveyor unit 15 which conveys the powder along the conduit 16 through the rounding station 8 and the welding machine 9 to the coating zone. At the end of the conduit 16 in the coating zone, the powder-air mixture is discharged as a cloud 17 the form of which may vary according to the configuration of the discharge section of the conduit 16 and/or that of the inner coating desired and which impinges on the interior of the can body.

So far, the method which has been described and the installation which has been illustrated are known. In accordance with the invention, part of the fluid flow in the conduit 16 is bled from the conduit upstream of the outlet section. In the example shown this is done by providing a suction conduit 18 which communicates with the conduit 16 at a point 19 and which is connected at its other end to a partial vacuum source 20 which extracts part of the fluid stream flowing along the conduit 16. Downstream of the partial vacuum source 20, the extracted fluid may be discharged to atmosphere, in which case a filter may be provided to retain any particles of coating powder which have been extracted together with the fluid.

The extraction of part of the fluid flow is able to bring about the advantages which have been described. In particular it means that the velocity at which the powder is conveyed by the compressed air in the conduit 16 can be maintained at a high level, resulting in a trouble-free transfer of powder along the extended conduit path. At the same time, the extraction causes the velocity of the powder-air mixture downstream of the extraction point 19, that is in the region 22, to be significantly reduced, with the result that the powder particles impinge on the internal wall of the can body at lower velocity, thus increasing coating efficiency. The rate of flow of the extracted fluid flow may be varied by adjusting the partial vacuum source. This adjustment may be made empirically, so that sufficient powder is deposited on the interior of the can body despite the extraction.

Figure 2:
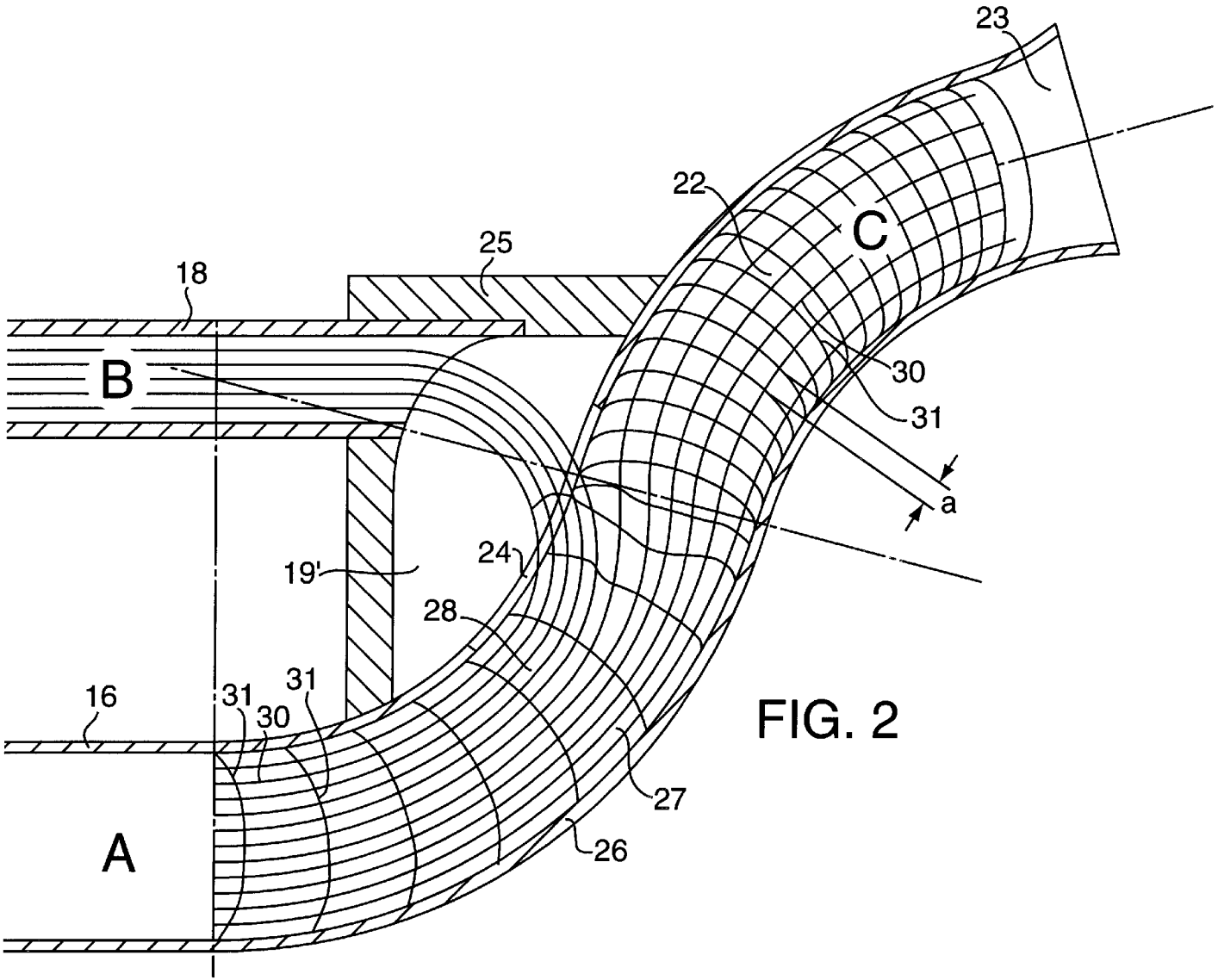
FIG. 2 shows the forward section of a conduit for the gas-powder mixture for coating can bodies, in a sectional view, with flow lines added.

FIG. 2 shows a preferred configuration of the downstream region of the conduit 16 conveying the powder-air mixture. In this embodiment, in which the same reference numbers denote the same parts as in FIG. 1, the powder-air mixture conveyed through the conduit 16 emerges from the outlet end 23 of the conduit. Extraction of part of the flow in the conduit 16 is, as already described, effected by means of the conduit 18 which communicates with the conduit 16 in a region 19'. For this purpose, a part of the wall of the conduit 16 is removed to form a corresponding opening 24. A connecting element 25 connects the two conduits 18 and 16 to one another, and forms an enclosed connecting chamber 19' through which the conduit 18 communicates with the interior of the conduit 16 via the opening 24. In the preferred embodiment shown, the total flow A of powder and air is divided into the two part flows B and C in such a way that the returned flow B essentially consists only of fluid (air) and contains no powder particles. The part flow B is bled after a bend region 26 of the conduit 16, and the centrifugal effect of this pipe bend is exploited here. Accordingly, the powder particles, which are heavier than the entraining gas, are mainly travelling along the bend wall which is on the right in the drawing, ie. in the region 27. In the region 28 of the bend cross-section seen on the left in the drawing, the entraining gas is largely free of particles, and can be extracted via the conduit 18 without significantly reducing the quantity of powder conveyed.

This configuration enables gas, necessary for material handling purposes, but disruptive in the spraying zone, to be separated from the gas-powder mixture. This, again, results in the advantages which have been described, as well as further benefits. Firstly, the rate of flow of the gas-powder mixture in the flow C is reduced, so that there is a sharp reduction in the relative velocity of the gas-powder stream with respect to the can body to be coated, which is being conveyed at a specific velocity. The effect of this reduction is that the powder particles have less tendency to bounce off the surface to be coated, and coating efficiency is thus improved. Furthermore, the powder particles being conveyed at a specific velocity are slowed by the rise in pressure and the associated decrease in velocity in the part flow C as a result of the momentum effect and are thereby swirled around into an almost homogeneous gas-air cloud over the entire cross-section of the conduit in the region C. This yields a powder coating with a more uniform thickness. Moreover, the bleeding of the part flow B upstream of the spray chamber reduces the flow of entraining gas which has to be extracted from the spray chamber, possibly resulting in simpler extraction arrangements. In addition, the bleeding of the part flow B by means of the partial vacuum source reduces the pressure-drop along the conduit 16, resulting in an increased mass flow throughput for a given entraining gas pressure.

In FIG. 2, streamlines 30 extending in the direction of flow are shown; the spacing of these lines indicates the prevailing pressure. Velocity lines 31 are also shown; the distance a between them is indicative of the flow velocity. It can be seen that in the region of flow A the transport velocity is high and pressure is low; this is desirable, in order that the powder may be conveyed along the extended conduit. In the region of flow C, on the other hand, the desired reduction in velocity and increase in pressure occur as a result of the extraction of the flow B. The powder particles which in the region 27 of the pipe bend are still travelling at high speed pass into this region of lower gas velocity and higher pressure, where they are swirled, as already described, to yield the desired homogeneous mixture which moreover is travelling at lower velocity than the flow A.

The pipe bend which has been described and illustrated provides a simple means for separating the powder-air mixture into a flow predominantly containing only air and a flow containing powder and air. Of course, it is also possible to choose other bend forms or other configurations of the conduit 16 which have a similar effect. Alternatively, other separating means which yield a similar effect, such as baffles, for example, could be used.

I claim:

1. Method for applying a coating to a can body having an inner surface, the method comprising the steps of:

conveying a particulate coating material along a transfer conduit by means of a fluid flow, the transfer conduit having a bend and an outlet section;

separating the particulate coating and the fluid flow into a particle-lean fluid flow and a particle-rich fluid flow at the bend in the transfer conduit;

bleeding the particle-lean part of the fluid flow from the transfer conduit at a bleed point located at the bend in the transfer conduit using a suction conduit located at the bleed point and coupled to a partial vacuum source; and discharging the particle-rich part of the fluid flow from the outlet section of the transfer conduit in a coating zone onto the inner surface of the can body.

2. Method according to claim 1, wherein the fluid flow is a gas flow for conveying a particulate coating material along the transfer conduit.

3. Method according to claim 1, further comprising the step of:

conveying along a conveyor into the coating zone a succession of can bodies to be coated.

4. Method according to claim 1, wherein the bend in the transfer conduit is an S-shaped bend.

5. Method according to claim 4, wherein the bleed point is located at the first curve of the S-shaped bend through which the fluid flows.

6. Apparatus for applying a coating to an object, the apparatus comprising:

a transfer conduit for conveying a particulate coating material from a feed container to a discharge opening of the conduit from which the coating discharges and impinges on a can body positioned at a coating zone, the transfer conduit also having a bend and an opening located at the bend upstream from the discharge opening;

a source of fluid for carrying the particulate coating in the transfer conduit using a fluid flow, the fluid flow being divided at the bend in the transfer conduit into a particle-lean fluid flow and a particle-rich fluid flow; and a suction conduit coupled to the transfer conduit at the opening and to a partial vacuum source for bleeding the particle-lean part of the fluid flow from the transfer conduit before the fluid flow reaches the discharge opening of the transfer conduit.

7. Apparatus according to claim 6, further comprising a conveyor device for the objects to be coated, the conveyor device extending in a conveying direction and conveying the objects to be coated through the coating zone, and wherein the transfer conduit extends parallel to the conveying direction.

8. Apparatus according to claim 6, wherein the bend in the transfer conduit is an S-shaped bend.

9. Apparatus according to claim 8, wherein the bleed point is located at the first curve of the S-shaped bend through which the fluid flows.

* * * * *